US006675681B1

(12) United States Patent
Beyrich et al.

(10) Patent No.: US 6,675,681 B1
(45) Date of Patent: Jan. 13, 2004

(54) METHOD OF PROCESSING SHEET-LIKE WORKPIECES IN A STRIP-SHAPED MANNER

(75) Inventors: Karlheinz Beyrich, Aue (DE); Achim Kreher, Aue (DE); Michael Georgi, Zwickau (DE)

(73) Assignee: Gebrueder Leonhardt GmbH & Co. KG, Aue (DE)

( * ) Notice: Subject to any disclaimer, the term of this patent is extended or adjusted under 35 U.S.C. 154(b) by 0 days.

(21) Appl. No.: 09/980,967

(22) PCT Filed: May 2, 2000

(86) PCT No.: PCT/EP00/04017

§ 371 (c)(1),
(2), (4) Date: Mar. 12, 2002

(87) PCT Pub. No.: WO00/66290

PCT Pub. Date: Nov. 9, 2000

(30) Foreign Application Priority Data

May 3, 1999 (DE) ..... 199 20 241

(51) Int. Cl.[7] ..... B26D 3/00
(52) U.S. Cl. ..... 83/40; 83/42; 83/50; 83/681
(58) Field of Search ..... 83/50, 679, 682, 83/683, 40, 681, 42, 923, 39, 713; 72/335–337, 330, 331, 339

(56) References Cited

U.S. PATENT DOCUMENTS

| | | | | | |
|---|---|---|---|---|---|
| 3,589,221 | A | * | 6/1971 | Deegan | 83/41 |
| 3,880,034 | A | * | 4/1975 | Sapolsky | 83/220 |
| 4,043,234 | A | * | 8/1977 | Godin et al. | 83/40 |
| 4,691,817 | A | * | 9/1987 | Haar | 198/468.2 |
| 5,400,652 | A | * | 3/1995 | Haar | 83/206 |
| 5,622,068 | A | * | 4/1997 | Sjoberg | 72/14.8 |
| 5,878,640 | A | * | 3/1999 | Haar | 83/206 |

FOREIGN PATENT DOCUMENTS

| | | | | |
|---|---|---|---|---|
| DE | 196 43 232 A1 | * | 11/1998 | |
| FR | 693348 A | * | 11/1930 | |
| JP | 06 218694 A | * | 8/1994 | 83/684 |

* cited by examiner

*Primary Examiner*—Allan N. Shoap
*Assistant Examiner*—Phong Nguyen
(74) *Attorney, Agent, or Firm*—Laurence A. Greenberg; Werner H. Stemer; Ralph E. Locher

(57) ABSTRACT

The invention relates to a method for machining platelike workpieces in a striated manner, whereby, in work steps, the material plate is machined by a controlled linear unit in a striated manner and always in the same X-axis direction. The invention also relates to a device for carrying out said method.

4 Claims, 3 Drawing Sheets

METHOD OF PROCESSING SHEET-LIKE WORKPIECES IN A STRIP-SHAPED MANNER

The invention relates to a method of processing sheet-like workpieces in a strip-shaped manner, the material sheet being worked in a strip-shaped manner in working steps by means of a controlled linear unit and always in the same X-axis direction.

German Patent 508 474 discloses a method of producing parallel cut or hole rows one after the other in blank material sheets. The material sheet, with the one longitudinal edge which runs parallel to the feed direction being placed against a stop strip, is first of all provided with a first cut row, is then removed completely from the region of the press and, for the purpose of producing the second and the following cut rows, in each case after being displaced in the sheet transverse direction, is fed again to the tool and always in the same feed direction. For producing the respectively second, third and following cut rows in the material sheet, the spacing of the rows is effected by placing the one original sheet longitudinal edge against a stop strip which can be adjusted at the same time in each case, so that finally the entire original material sheet is pierced with cut or hole rows in the manner described above and can be discarded.

On the other hand, however, it is also possible,when each row is stamped or cut out, for the scrap (stamped grid) which is being produced or has been produced to be cut off from the original or the previous longitudinal edge at a distance corresponding to the spacing of the rows. In this way, the original material sheet, each time the stamped-grid strip is dispensed with, is reduced down to the last strip, which is then discarded after the stamping of the hole rows.

This prior art has the disadvantage that in each case only a single material sheet is worked in cut rows, the material sheet already provided with a cut row being taken completely out of the region of the press in each case and passing via a relatively large distance behind the press in the same feed direction again into the region of the-cutting tool, with the result that considerable time is needed for working a material sheet.

Furthermore, PCT/SE 93/00820-WO 94/08740 discloses a method and an apparatus for processing sheets on C-frame presses, this apparatus progressively working a material sheet in a strip-shaped manner in the X-direction in a horizontal processing plane. After a strip has been progressively processed from the metal sheet and subdivided into sections, the respectively remaining residual grid is in each case subsequently separated and removed section by section. After this, the remaining residual sheet is returned at the level of the bottom tool position above the table fixed to the frame into the initial position, is displaced transversely to the processing direction by one strip width, and is progressively processed again in the X-direction.

This type of sheet processing enables a single metal sheet to be worked in a strip-shaped manner in steps from the selected first feed side in each case, so that, as a result of the return, larger time intervals inevitably occur in each case in which no cut parts are produced. A high discharge sequence of workpieces cannot be achieved by means of this method either.

The object of the invention, then, is to propose a method of processing sheet-like workpieces in a strip-shaped manner for high working frequencies.

SUMMARY OF THE INVENTION

According to the invention, this object is achieved in terms of the method by the features of patent claim 1.

In this case, the processing method is based on the fact that at least two material sheets are always alternately and cyclically processed in a strip-shaped manner in working steps and always in the same X-axis direction. In this case, a first material sheet is worked cyclically in a strip-shaped manner in the X-axis direction at its bottom side end, and a further material sheet follows the first material sheet in the same X-axis direction. After the last processing step on the strip, being processed, of the first material sheet has been effected, the respectively bottom side is directly worked from a second material sheet in a strip-shaped manner in the same X-axis direction.

The first material sheet, reduced by one material strip, is now returned directly at the processing space against the X-axis feed direction into the initial position and is corrected in the Y-axis direction in the strip depth to be worked. This first material sheet, which has thus been returned, will now in turn directly follow the last working step of the second material sheet, a further strip-shaped part being worked cyclically from this first material sheet. This processing of strip-shaped parts of material sheets in always the same X-axis direction is continued until one material sheet has only a last strip-shaped material-sheet part, which, as described according to the invention, is processed cyclically. A new material sheet then follows this respectively last strip-shaped material-sheet part of each cyclically worked material sheet, and this new material sheet then follows the material sheet, still being processed, in the X-axis processing direction.

Thus it is possible for the first time to cyclically work material sheets in a strip-shaped manner in always the same X-axis direction at high working frequencies without time losses.

The material sheet prepared for the sheet processing, before a strip is worked cyclically, is advantageously moved laterally into the processing plane, is processed, and is moved out of the processing plane again after the separation of the residual grid.

A further design of the invention is seen in the fact that the material sheets to be worked cyclically, including the last strip-shaped part of a material sheet, are in each case returned laterally outside the processing plane against the X-axis direction of the processing into the respective ready position.

In an especially advantageous manner, the invention is characterized in that directly following the strip-shaped end of each material sheet, including the last strip end of a material sheet, in a cyclical manner is in each case a start of the following material sheet, including the strip-shaped start of a worked material sheet.

BRIEF DESCRIPTION OF THE DRAWINGS

The Invention is described in more detail below with reference to an exemplary embodiment.

In the drawings.

DESCRIPTION OF THE PREFERRED EMBODIMENTS

Figure 1A:
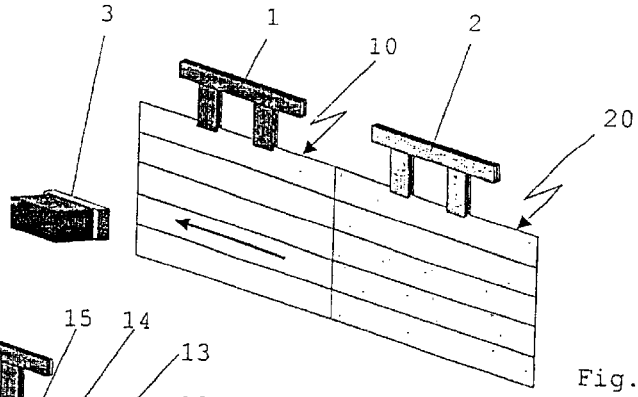
FIGS. 1*a* to *e*.
Figure 1B:
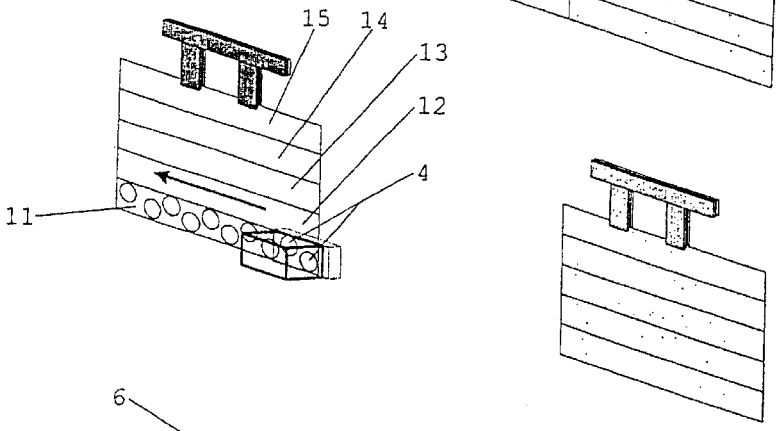
Figure 1C:
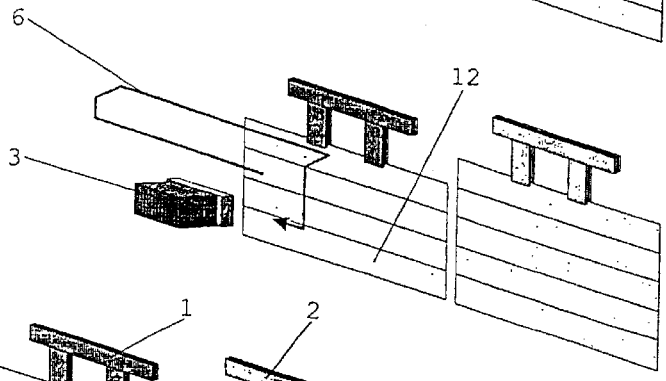

The method according to the invention for processing material sheets is shown schematically from FIG. 1*c* to FIG.

3*o* in individual method steps. In all the FIGS. 1*a* to *e*, 2*f* to *j* and 3*k* to *o*, for the sake of clarity, the material sheets are merely shown symbolically in individual strip-shaped parts.

In principle, however, the connection of a lowermost strip-shaped residual grid is always severed only when the last cut/drawn part has been produced.

FIGS. 1*a*, 1*b* illustrate, as it were, a single starting sequence for a material sheet 10 by means of the feed device 1, during which starting sequence cut/drawn parts 4 are cut out of a first bottom material-sheet strip 11 by means of the cutting/drawing tool 3.

In the process, the remaining residual grid of the material-sheet strip 11, during. each stroke of the cutting/drawing tool 3, by means of a tool cutting-edge part, is separated from the remaining material sheet, which then still consists of the strip parts 12, 13, 14, 15, and is removed as an entity from the region of the processing with the last separating stamping of the material-sheet strip 11, in other words when the connection with the material sheet then remaining is severed.

FIG. 1*a* therefore represents a single ready position of the two material sheets 10, 20 being processed, which are each provided at the start of sheet processing, in order to provide a positioning difference or spatial difference for the holding and feed devices 1, 2.

In FIG. 1*b*, therefore, a first material sheet 10 is fed to the left to the tool 3 in arrow direction 5 by means of a holding and feed device 1, while the second material sheet 20 remains located in the waiting position with holding and feed device 2.

After the processing of the first lowermost double row of cut/drawn parts 4 from the material-sheet strip 11, the residual grid consisting of this material-sheet strip is removed. The first material sheet 10, according to FIG. 1*c*, now consists of the material strip parts 12, 13, 14 and 15.

The arrow guide 6 in FIG. 1*c* illustrates, in this schematic representation, that the sheet size reduced by one material strip, after leaving the cutting/drawing tool 3 on the left side, performs a positioning movement away from the processing plane, returns into the initial position and is adjusted by one material-sheet strip. The material strip 12 to be processed is therefore in front of the cutting/drawing tool 3 and the first material sheet 10 is thus worked again.

The processing method according to the invention starts at this point by in each case two material sheets 10, 20 being alternately worked cyclically in a strip-shaped manner in the X-axis direction.

Figure 1D:
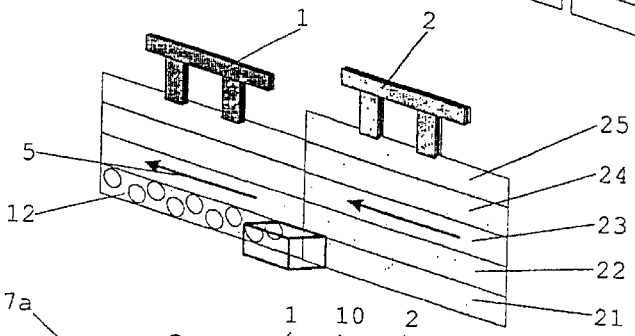

According to FIG. 1*d*, the material-sheet strip 12 is worked from the material sheet 10 in arrow direction by producing cut/drawn parts 4, e.g. can lids, is completely separated from the remaining material sheet and is discarded as residual-grid strip.

In the same X-axis direction, directly with the last stamping of the cut/drawn parts 4 from the material-sheet strip 12, the material sheet 20 with the material-sheet strip 21 is fed to the cutting/drawing tool 3 and subsequently worked cyclically in a strip-shaped manner.

Figure 1E:
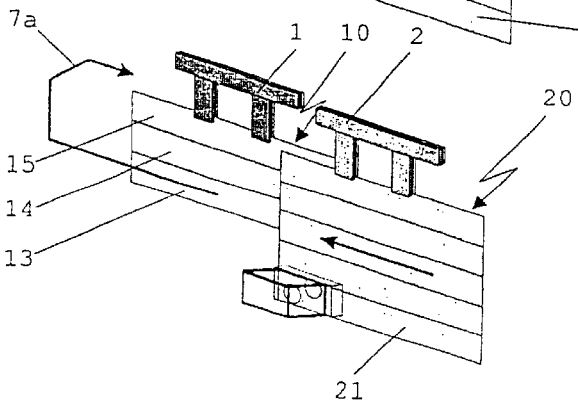

FIG. 1*e* illustrates that the remaining material sheet 10, which now consists of the material-sheet strips 13, 14, 15 and is returned again in arrow direction 7*a* directly past the working space below or behind the material sheet 20 against the X-axis feed direction into a ready position, while the lowermost material-sheet strip 21 is worked cyclically from the second material sheet 20 in the X-axis direction.

Figure 2F:
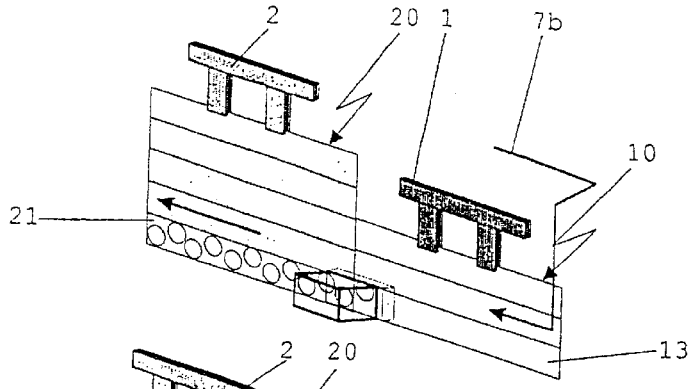
FIGS. 2*f* to *j*.

FIG. 2*f*, on the left side, illustrates the completion of the cyclical working of the material-sheet strip 21 from the material sheet 20, while the material sheet 10 is returned against the X-axis processing direction below or behind the material sheet 20 being processed, is advanced up to the working space according to arrow direction 7*b*, is adjusted by one material-sheet strip depth in the Y-axis direction and directly follows the material sheet 20 in the X-axis direction in the cutting/drawing tool 3, and a first stamping stroke of the material strip 13 is carried out.

Figure 2G:
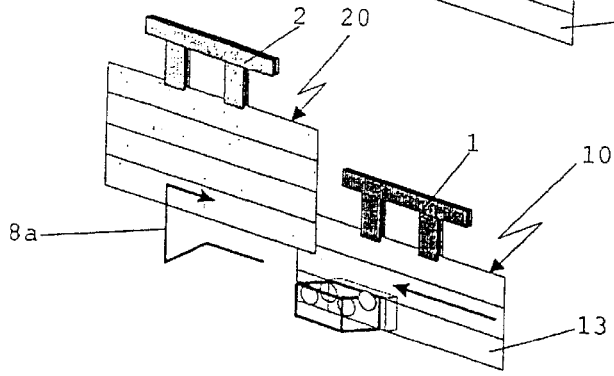

FIG. 2*g* illustrates that the lowermost material-sheet strip 13 is worked cyclically from the material sheet 10, while the material sheet 20 is brought back again according to arrow direction 8*a* in front of or above the material sheet 10 against the X-axis feed direction past the working space into a ready position.

Figure 2H:
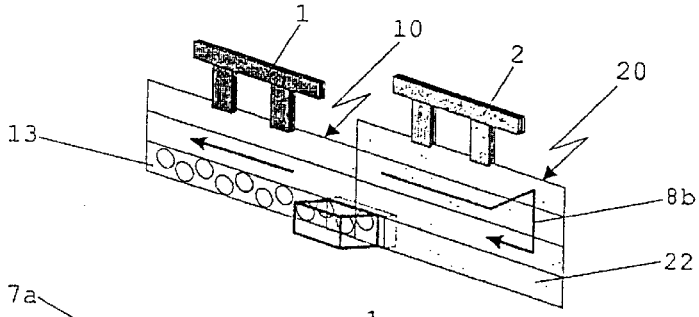

In FIG. 2*h*, on the left side, the sheet strip 13 is worked cyclically from the material sheet 10, and the material sheet 20 is adjusted by a further strip depth in the Y-axis direction according to the arrow regime 8*b*, so that the sheet strip 22 is cyclically processed. At this point, the method according to the invention for processing material sheets has been carried out by virtue of the fact that in each case two material sheets 10, 20 are worked alternately in a strip-shaped manner.

Figure 2I:
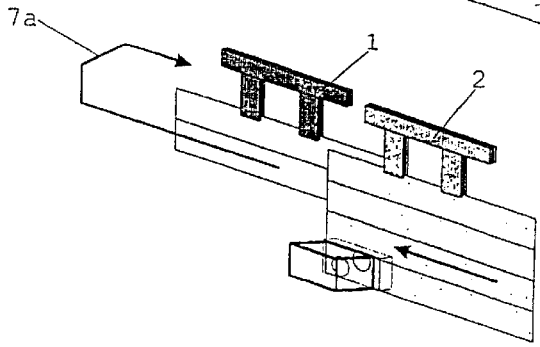
Figure 2J:
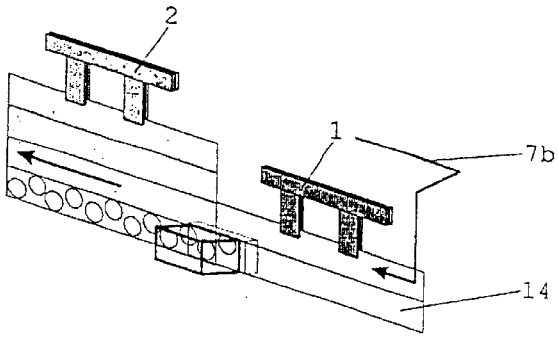
Figure 3K:
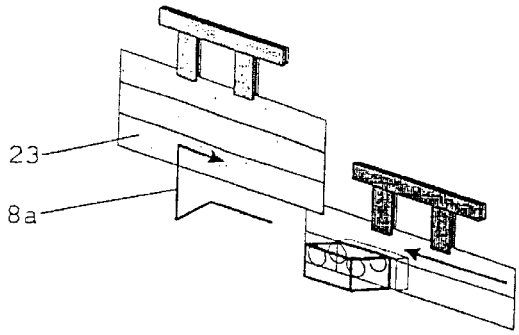
FIGS. 3*k* to *o* show the schematic sequence of the method of processing sheet-like workpieces in a strip-shaped manner.

In FIG. 2*i* and FIG. 2*j*, the sequence already described according to the arrow regime 7*a*, 7*b*, as presented according to FIG. 1*e* and FIG. 2*f*, is merely repeated, with the difference that, firstly, a material sheet 10, as bottom or rear material sheet, assumes the leading role in the working space of the cutting/drawing tool 3, and after this the material sheet 20 is made to follow up, whereas the material sheet 20, in front of or above the material sheet 10, subsequently takes the leading role in the working space of the cutting/drawing tool 3 according to the arrow regime 8*a*, 8*b*, see FIG. 3*k* and FIG. 3*e*. With each processing sequence, the respective material sheet is alternately reduced by one bottom material-strip part, so that, finally, according to FIG. 3*m*, on the right side, the material sheet 10 consists only of the last material-strip part 15.

This last material strip 15 is now advanced up to the working region of the cutting/drawing tool 3 according to arrow regime 7*a*, 7*b* by means of the feed device 1 and is taken over by a feed device 9, which then moves the remaining sheet strip cyclically through the cutting/drawing tool 3 in the X-axis direction. This processing operation is shown schematically in FIG. 3*n*.

Figure 3L:
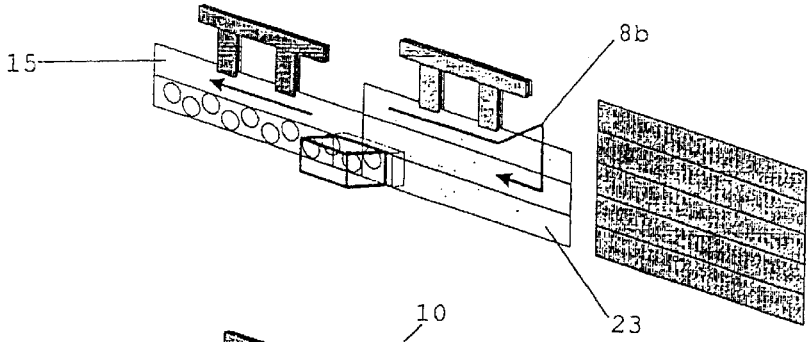
Figure 3M:
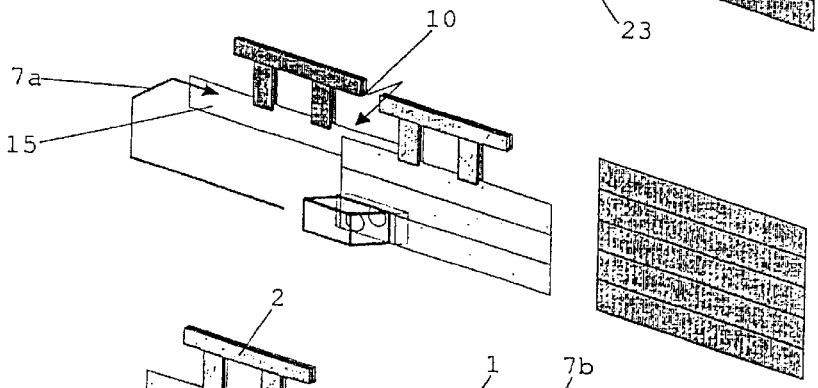
Figure 3N:
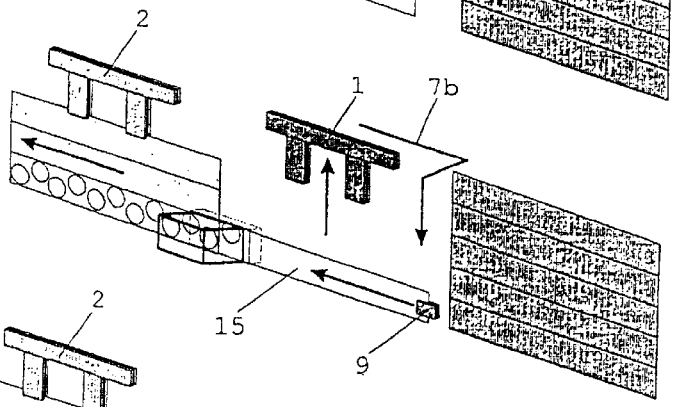
Figure 3O:
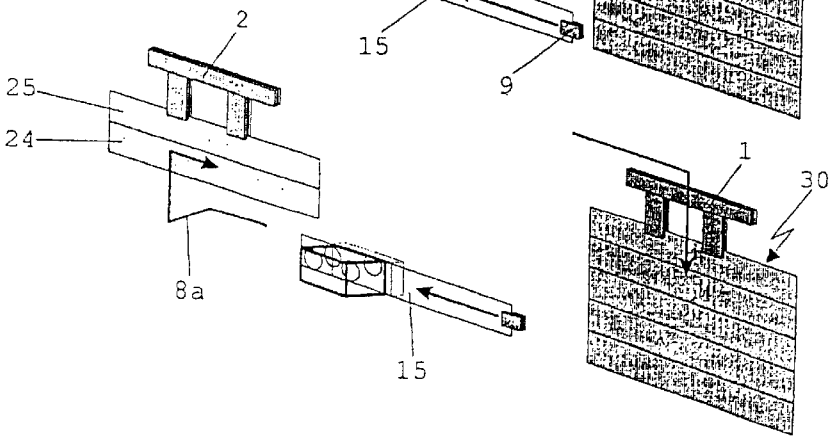

From FIG. 3*l*, a new sheet 10 is prepared, so that the feed device 1, after it has delivered the last strip-shaped part 15 to the feed device 9 according to FIG. 3*n*, can take over a new material sheet 30 according to FIG. 3*o*. As described above, the processing sequence of the material sheet 20 with the material-sheet strip 23 and 24 takes place according to the arrow regime 8*a*, 8*b*, so that ultimately, according to FIG. 3*o*, the material-sheet strip 25 still remaining can also be taken over by the feed device 9 and is worked cyclically, and consequently the feed device 2 can likewise take over a new material sheet. By means of the method steps described in detail, it is possible for the first time to alternately work material sheets cyclically in a strip-shaped manner in always the same X-axis direction at high working frequencies without time losses.

List of Designations

1 Feed device of the workpiece sheet 10
2 Feed device of the workpiece sheet 20
3 Cutting/drawing tool
4 Cut/drawn part—e.g. can lid

5 Arrow direction according to FIG. 1*a*
6 Arrow direction according to FIG. 1*c*
7*a* Arrow direction according to FIG. 1*e*
7*b* Arrow direction according to FIG. 2*f*
8*a* Arrow direction according to FIG. 2*g*
8*b* Arrow direction according to FIG. 2*h*
9 Feed device for respectively last material-sheet strips
10 First material sheet
11 Material-sheet strip of the material sheet 10
12 Material-sheet strip of the material sheet 10
13 Material-sheet strip of the material sheet 10
14 Material-sheet strip of the material sheet 10
15 Material-sheet strip of the material sheet 10
20 Second material sheet
21 Material-sheet strip of the material sheet 20
22 Material-sheet strip of the material sheet 20
23 Material-sheet strip of the material sheet 20
24 Material-sheet strip of the material sheet 20
25 Material-sheet strip of the material sheet 20
30 Third material sheet

We claim:

1. A method of processing material sheets, which comprises:

providing material sheets each having a bottom sheet end with a bottom sheet margin;

processing the material sheets in strips in each case at the bottom sheet end in working steps in an X-direction, and thereby stamping out cut parts from the respective lowermost material-sheet strip and ejecting the cut parts and forming a stamped-grid strip;

thereafter progressively cutting respective stamped-grid strips from the material sheet parallel to a bottom sheet margin and removing the strip grid after complete separation;

wherein the processing step comprises alternately processing two material sheets in strips, with a first material sheet being worked cyclically along a strip in the X-direction, a second material sheet being fed in the X-direction, and the second material sheet being subsequently worked cyclically along a strip, while the first material sheet, now reduced by one material strip, is returned directly past a processing space counter to the X-direction into a ready position, is adjusted in a Y-direction by a strip depth to be worked, and then cyclically follows the second material sheet in the X-direction, and wherein a further strip is worked cyclically from the first material sheet, and a new material sheet to be processed is made to follow the respectively last strip of each worked material sheet in the X-axis direction.

2. The method according to claim 1, which comprises, before a strip is worked cyclically, moving each new material sheet laterally into the working space and laterally out of the working space after the separation of the stamped-grid strip.

3. The method according to claim 1, which comprises returning the material sheets, including the respectively last strip, laterally outside the working space against the X-axis direction into the ready position.

4. The method according to claim 1, which comprises causing a start of a following material sheet, including the strip-shaped start of a worked material sheet, to directly follow in a cyclical manner the strip-shaped end of each material sheet, including the respectively last strip end of the material sheet.

* * * * *